United States Patent [19]

Ruble

[11] Patent Number: 4,477,118

[45] Date of Patent: Oct. 16, 1984

[54] RECLINING AND ROCKING OFFICE CHAIR

[75] Inventor: Harold P. Ruble, Deerfield, Mich.

[73] Assignee: La-Z-Boy Chair Co., Monroe, Mich.

[21] Appl. No.: 355,204

[22] Filed: Mar. 5, 1982

[51] Int. Cl.[3] ..... A47C 1/02

[52] U.S. Cl. ..... 297/85; 297/68; 297/270; 297/DIG. 7

[58] Field of Search ..... 297/68, 83, 84, 85, 297/270, 271, DIG. 7

[56] References Cited

U.S. PATENT DOCUMENTS 3,603,641 9/1971 Knabusch et al. ..... 297/85 X
3,638,995 2/1972 Flanagan et al. ..... 297/DIG. 7
3,926,472 12/1975 Evans ..... 297/DIG. 7
4,383,714 5/1983 Ishida ..... 297/68 X

FOREIGN PATENT DOCUMENTS 1414175 11/1975 United Kingdom ..... 297/68

*Primary Examiner*—James T. McCall
*Attorney, Agent, or Firm*—Harness, Dickey & Pierce

[57] ABSTRACT

An office chair has a mobile pedestal carriage with a cross span beam on which relatively movable chair frame, seat frame, and leg rest frame assemblies are mounted for rocking motion under the control of an adjustable spring mechanism and a ratchet mechanism that inhibits rocking if the leg rest is in the extended position.

10 Claims, 9 Drawing Figures

RECLINING AND ROCKING OFFICE CHAIR

BRIEF SUMMARY OF THE INVENTION

This invention relates to upholstered office chairs that are rockably mounted on mobile pedestal-type carriages and have reclining backs and movable leg rests.

It is a purpose of the invention to simplify and strengthen the construction of such an office chair and to improve its operation.

In a preferred embodiment of the invention, a mobile, pedestal-type carriage has a transverse span beam on which a chair frame assembly is rockably mounted under the control of a spring means and rachet means acting between the beam and chair frame. The chair frame assembly supports seat, back and leg rest frames which are movable relative to each other and to the chair frame. The back and seat frames are interconnected by linkage based on the chair frame, including a unique metal arch at the front of the chair, so that reclining movement of the back in response to applied pressure from the back of a chair occupant also moves the seat upwardly and forwardly. The chair preferably has an adjustable leg rest which is operated independently of the back and seat by means of a hand lever which turns a drive shaft to activate leg rest linkage which is supported on said metal arch of the chair frame assembly. A spring pressured toggle mechanism, based on said transverse span beam, is preferably used to hold the leg rest in extended position and provide a spring assist in raising it.

Other features will be described hereinafter.

DESCRIPTION OF THE DRAWINGS

FIG. 5 is a top plan view, broken away, of left hand portions of the chair and seat frame assemblies, the right hand portions being substantially symmetrical and similar;

FIG. 6 is a top plan view, broken away, of the chair and leg frame assemblies, of the top of the carriage assembly, and the cross drive shaft and associated parts for the left side of the chairs (the right side being substantially symmetrical and similar except for omission of mechanism 71 and lever 261);

DESCRIPTION OF THE INVENTION

Figure 1:
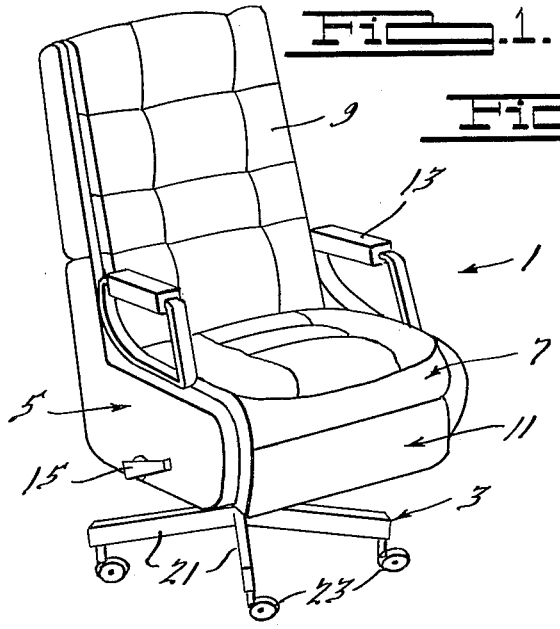
FIG. 1 is a perspective view of an office chair embodying the invention showing it in final, upholstered condition; all remaining views showing parts of the chair of FIG. 1 with the padding, springs, upholstery, and the like omitted for the sake of clarity and ease of illustration.

Referring first to FIG. 1, the office chair 1 comprises a mobile pedestal type carriage assembly 3 which rockably supports a chair frame assembly 5. The chair frame assembly 5, in turn, supports a seat frame assembly 7, a back frame assembly 9, and a leg rest assembly 11. The back frame assembly is reclinable; that is it is movable backwardly from the upright position of FIG. 1. When this occurs, the seat frame assembly 7 moves upwardly and forwardly, to some extent, to maintain comfort of the chair occupant. Arm rest frames 13 may be mounted on the chair frame. The leg rest assembly 11 is manually operated by the handle 15 at the right side of the chair which turns a cross shaft 16 of square cross section. Pulling the handle 15 upwardly, i.e., counterclockwise turning, raises the leg rest. Subsequent turning of the handle 15 forwardly, i.e., clockwise, lowers the leg rest. If the chair frame assembly is rocked backwardly on the carriage assembly 3 when the leg rest is raised, it is held in the backward position against forward rocking by a ratchet mechanism 17 (FIG. 3) but this is released upon lowering of the leg rest assembly so that the chair frame assembly then rocks forwardly.

The carriage assembly 3 has the usual swivel center post or column 19 which is adjustable in vertical length to vary the height of the chair seat. Extending radially outwardly from it are diverging arms 21. At the outer ends of the arms 21 are caster wheel mechanisms 23 to support the chair 1 on a floor surface so that it can be easily rolled around in any direction.

Figure 3:
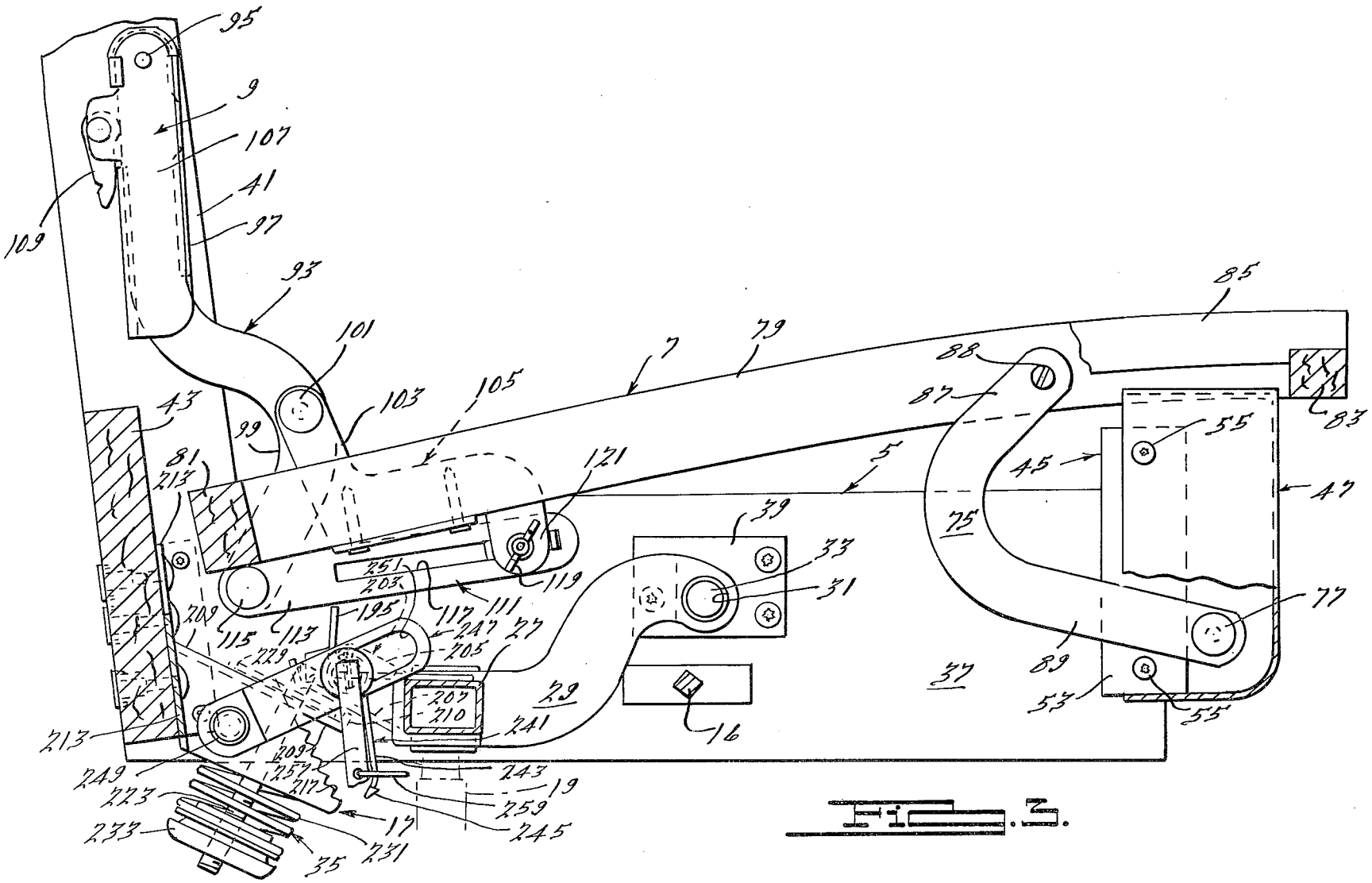
FIG. 3 is a vertical cross section through the chair frame and seat frame assemblies of the chair of FIG. 1 and also through the spring and ratchet mechanisms and top part of the carriage assembly.

The center column 19 includes a thrust bearing (not shown) that takes all load on the chair while still permitting it to swivel or rotate about the vertical axis of the column. This axis is located midway between the left and right hand sides of the chair but much closer to the back of the chair than to the front, as can be seen in FIG. 3. The top of column 19 includes a conical end that fits in a mating socket 25 at the midpoint of a rigid transverse metal span beam 27. This beam supports the rest of the chair and transfers chair loads into the column. Rigid metal arms 29 are secured by welding or the equivalent to opposite ends of the beam 27. They extend forwardly of the beam and are curved to extend upwardly and outwardly with respect to the beam. At their outer ends are circular openings 31, located on a common, horizontal axis which is above and forward of the beam 27. The openings 31 pivotably receive pivot pins 33 which extend inwardly along said horizontal axis from opposite sides of said chair frame assembly 5, whereby this assembly is mounted on the carriage for rocking movement about said horizontal axis. Such movement is resisted by an adjustable spring means 35 associated with the ratchet mechanism 17.

Figure 9:
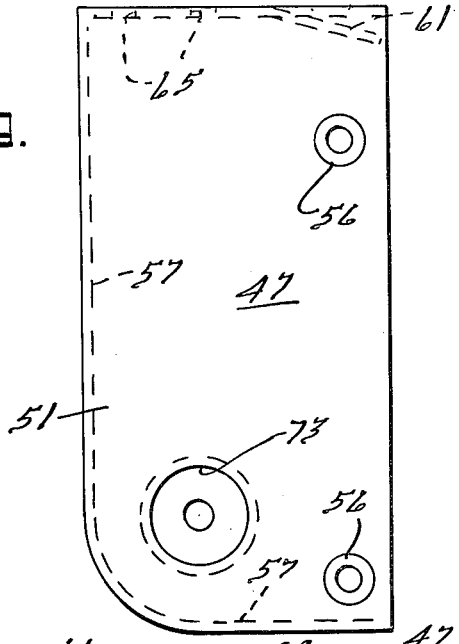
FIG. 9 is a side elevation taken from the right of FIG. 7 showing the left hand side flange of the cross rail.
Figure 7:
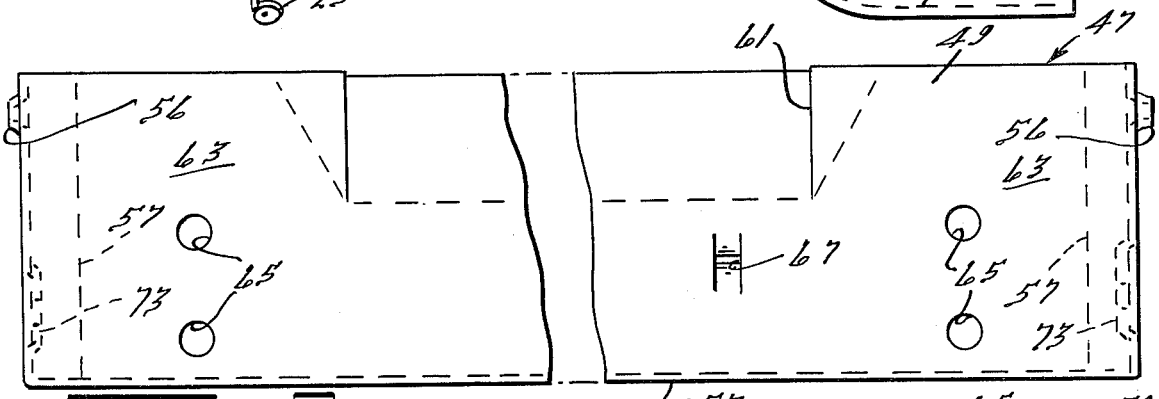
FIG. 7 is a top plan detail view of the metal cross rail for the chair frame assembly, the front of the rail appearing at the bottom of FIG. 7.
Figure 8:
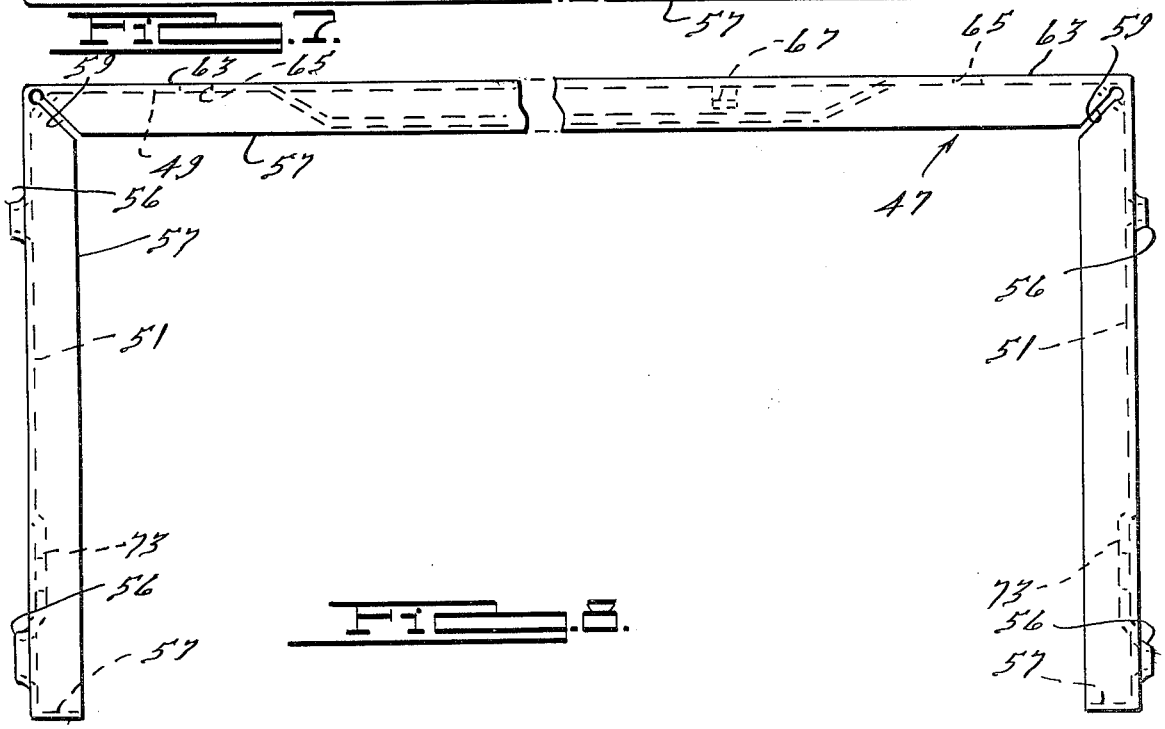
FIG. 8 is a side elevation taken of the front of the rail of FIG. 7.

The chair frame assembly 5 includes left and right hand slightly diverging wooden side members 37. Brackets 39 carrying the pivot pins 33 are secured to the inside faces of the members 37 (FIG. 3). The rear ends of the side members 37 have vertically extending post sections 41 and the left and right hand sides are solidly interconnected by a wooden rear cross frame member 43. The front ends of the side members 37 have short, inwardly extending, vertical, wood posts 45 rigidly secured to them to form a part thereof. The side members 37 are solidly interconnected at their front ends by a unique rigid metal cross frame member or cross rail 47 which is rigidly secured to the inside edges of the posts 45. Thus, the chair frame assembly 5 comprises the wooden side members 37, the wooden rear member 43, and the metal front member 47. The front cross rail 47, as seen best in FIGS. 7–9, is of a rectangular arch construction comprising a horizontal section 49 and vertical side sections 51 at opposite ends of the horizontal section. The side sections 51 are rigidly secured to the inside faces 53 of the vertical posts by means of screws 55 or the equivalent (FIG. 3) extending through apertured, outwardly pressed embossments 56. The configuration of the rail 47 is such that it may be pressed from sheet steel. The side sections 51 are bent at right angles to the main, horizontal section 49 after a transverse flange 57 has been bent in the front and the ends of the rectangular metal strip from which the rail is formed. Slots 59 in the flange at the corners of the sections 49 and 51 permit the sections to be bent to the right angle arch shape after formation of the flange. In addition to providing a blunt front surface for the rail 47 (and for the bottom edges of sides 51) the flange 57 rigidifies it, as does a rather long depression 61 pressed into section 49 and slanting down to the rear edge thereof. Flat portions 63 are in the section 49 on opposite sides of the depression 61 and each contains a pair of openings 65 whereby the foot rest operating mechanism, to be described, is supported by the cross rail 47. The flat part of the section 49 ahead of the depression 61 is slit and pressed down to form a shallow loop 67 that serves as an anchor for the top end of a coil spring 69 (FIGS. 2 and 6) at the front of an adjustable leg rest holding device 71 of the type fully described in U.S. Pat. No. 3,325,210, issued June 13, 1967 and assigned to the assignee of the present invention. The sides 51 have apertured inwardly pressed embossments 73 formed in them adjacent the front, bottom corners whereby front links 75, forming a part of the seat frame assembly 7, may be pivoted to the chair frame assembly 5 by way of pivot pins 77. Thus, the front component of seat load is transferred into rail 47.

Figure 5:
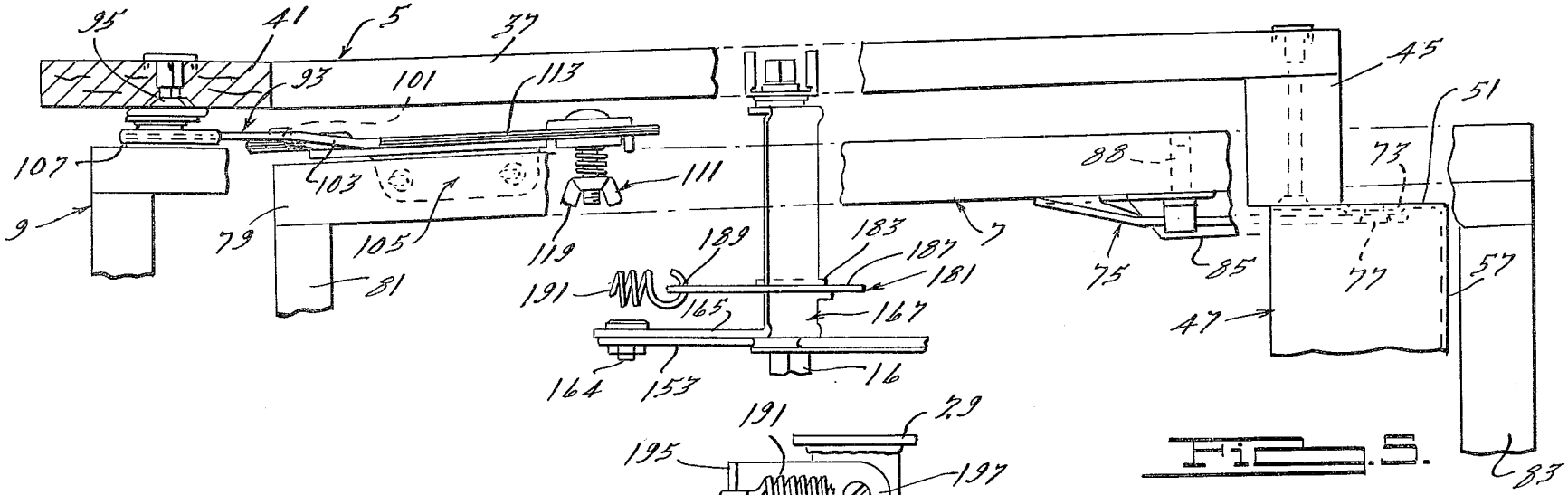

The seat frame assembly 7 is similar to one shown for a lounge chair in copending U.S. application, Ser. No. 154,374, filed May 29, 1980 (Now U.S. Pat. No. 4,367,895), of Wiliam Pacitti and Harold P. Ruble, entitled Reclinable Chair, and assigned to the present assignee. It comprises a seat frame formed by slightly curved left and right hand wooden side members 79 which are solidly interconnected at their rear ends by the wooden rear cross frame member 81 and at their front ends by the wooden front cross frame member 83. The front ends of the members 79 and the interconnection with the front rail 83 are reinforced by longitudinal blocks 85 which also partially cover the curved top ends 87 of the upside-down J-shaped front links 75 (FIG. 3). The top ends 87 are pivoted at 88 to the seat side frame members 79 and are slightly offset (FIG. 5) from the straight stems 89 which are pivoted at 77 to the cross rail side sections 51.

The front links 75 are the front part of a metal parallelogram type linkage mechanism which supports the seat frame on the chair frame assembly so that as it moves horizontally it also moves up or down, depending upon whether it moves to the front (during recline of the back assembly 9) or to the rear on return to the upright position. The parallelogram seat support mechanism also includes left and right hand rear swing links 93 which extend vertically upwardly along the insides of the chair frame post sections 41 to which they are pivoted at 95 (FIG. 3). The long straight top portion 97 of each link 93 is almost perpendicular to the bottom edge of the side members 37, i.e., the floor, but does slant a little forwardly as it curves to blend into the lower reversely curved postion 99 of the link. The front parts of the curved portions 99 on the links 93 are pivoted at 101 to upstanding sections 103 on angle shaped brackets 105 that have horizontal flanges securely fixed to the bottom faces of the left and right hand seat side frame members 79 at the rear of the seat frame.

Load at the rear of the seat frame is taken by the brackets 105 and passed through pivots 101 into the rear links 93 which transfer it through pivots 95 into the chair frame assembly 5. The rear of the seat frame moves in the manner of a controlled pendulum on and below the pivots 95 while the front of the seat frame swings on links 75. The J-shape of the links 75 permits the pivots 88 to go over center (i.e., over pivots 77) when the seat frame has moved to its upper and most forward positions.

The back frame assembly 9 is not shown in detail but the left hand side slide bracket 107 of this assembly is shown in FIG. 3, there being a similar bracket on the right hand side. The brackets are fixed to the outer faces of side frame members of the back frame assembly 9 and, as more fully described in U.S. Pat. No. 3,525,549, issued Aug. 25, 1970, to Edward M. Knabusch and Edwin J. Shoemaker, entitled Detachable Chair Back, and assigned to the assignee of this invention, provide means whereby a seat back of desired construction can be slidably and removably mounted on the straight portions 97 of the rear seat links 93 and locked in place with latches 109. When the back frame assembly 9 by way of slide brackets 107 is mounted on the links 93, it in effect serves as an extension of the links above their pivot points 95 to the chair frame assembly. The back frame can be tilted on the pivots 95 and acts as a lever means to angularly move the rear links 93 about the pivots and, therefore, also move the seat frame.

The force required for this tilting may be made selectively adjustable through the use on each side of the seat of a controllable resistance means 111 of a type shown in said U.S. Pat. No. 3,525,549 or in more detail in U.S. Pat. No. 3,096,121, issued July 2, 1963. This involves a pair of laminated or multiple layer friction link means 113 each of which has one end pivoted at 115 to the bottom of a swing link 93. It has a slot 117 through its plural layers to receive the stem of a spring pressed wing nut-screw-and-washer combination 119 that is mounted on the downwardly extending front flange 121 of the seat bracket 105. The frictioned resistance of the links 113 to sliding on flanges 121 and thus to movement of the links 93 can be adjusted by turning the wing nut combination 119 to suit the user of the chair 1. Thus, the resistance of the back frame assembly 9 to movement on the pivots 95 is adjustable through the mechanism 111.

Movement of the back frame assembly 9 in a counterclockwise direction about pivots 95 occurs when the occupant of the chair 1 lets his or her back rest heavily against the back of the chair. Most of this weight will be concentratcd above the pivots so that the slide brackets 107 will pivot the swing links 93 forwardly about pivots 95. This moves pivots 101 forwardly and upwardly and also moves the rear end of the seat assembly 7 in the same way. Such movement creates clockwise swinging of front seat links 75 about pivots 77 and movement of these links controls motion of this front end of the seat frame. Thus, the seat frame moves conjointly with the back frame during recline to provide seating confort. If the chair occupant removes weight from that part of the back 9 above the pivots 95, as by leaning forwardly in the chair, more weight is taken by the seat frame assembly 7. This will let the links 93 swing back, like pendulums, toward their nearly vertical positions of FIG. 3, returning the seat frame toward the position of FIG. 3 and the back toward its upright position of FIG. 1.

While, as just described simple shifting of weight by the chair occupant actuates relative movement of the back and seat assemblies 7 and 9, the leg rest frame assembly 11 must be manually operated by turning the handle 15. The mechanism whereby the handle 15 operates the leg rest, to be described hereinafter, is an adaptation to an office chair of structure of the type described in the aforementioned copending U.S. patent application Ser. No. 154,374 (now U.S. Pat. No. 4,367,895) for use in a residential lounge chair. Lounge chair mechanisms of a similar type are also described in U.S. Pat. Ser. No. 4,179,157, issued Dec. 18, 1979, as well as in the aforementioned U.S. Pat. No. 3,325,210.

The leg rest frame assembly 11 includes a wooden H shaped leg rest frame member 125 (FIG. 6) which has a transverse flat panel web section 127 and longitudinal flat panel side legs 129. In the retracted position of the leg rest, the rear ends of the side legs, 129 rest in the notched-out corner areas 131 defined by the chair frame blocks 45 and the adjacent side legs 51 of the cross rail 47 while the web section 127 nestles closely to the front edge of the cross rail 47 (FIGS. 1 and 6).

Figure 2:
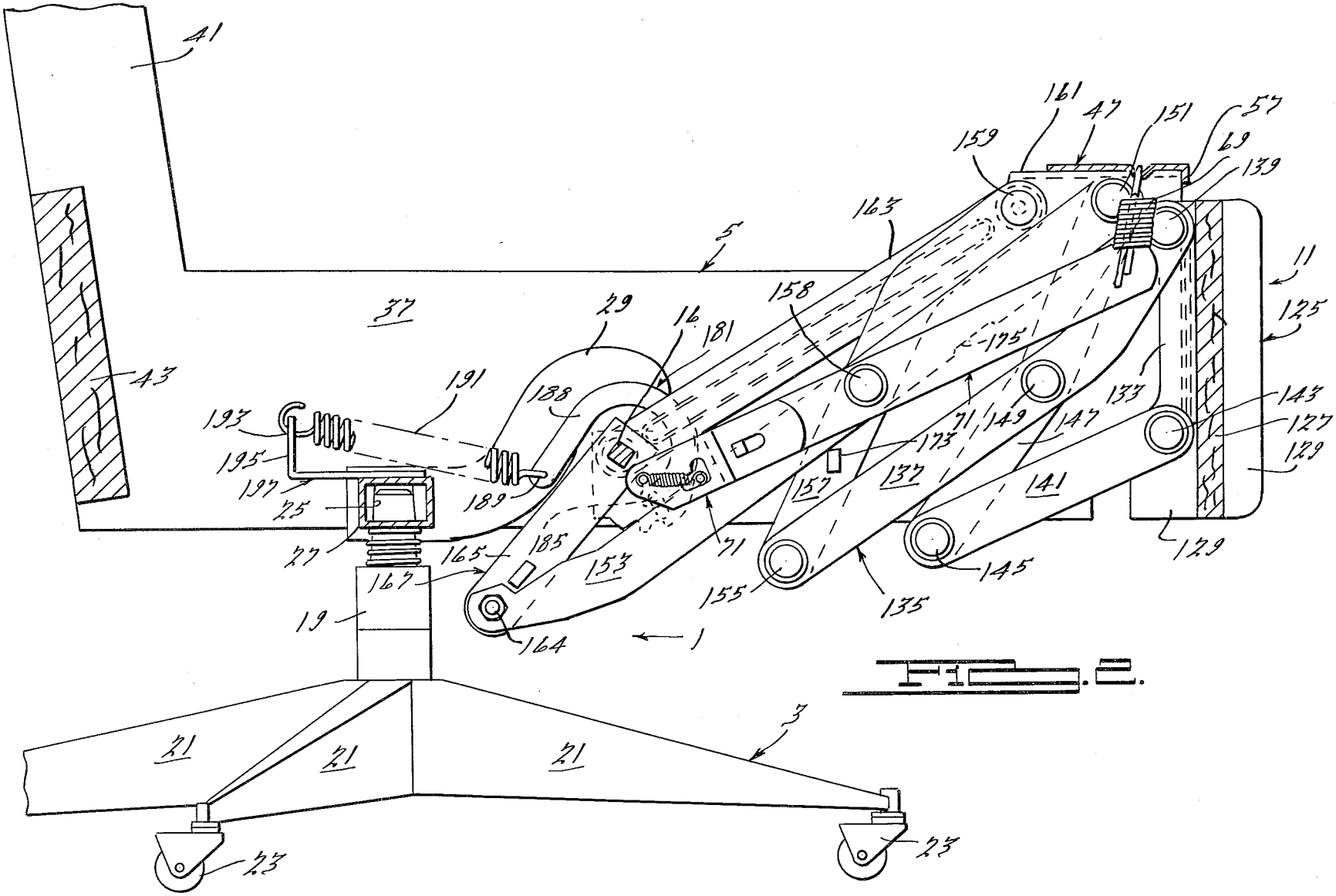
FIG. 2 is a vertical cross section through the chair frame, carriage, and leg rest frame assemblies of the chair of FIG. 1.

The flat web section 127 has left and right hand relatively long angle-shaped vertical brackets 133 solidly secured to its inside face (FIG. 2). Each is pivotally supported on an extensible pantograph mechanism 135. Pantograph link 137 is pivoted at 139 to the upper part of bracket 133 and link 141 is pivoted at 143 to the lower part of the bracket. Link 141 is pivoted at 145 to the bottom of link 147 and link 137 is pivoted at an intermediate point to an intermediate point of link 147 as seen at 149. The top of link 147 is pivoted at 151 to the top of long support link 153 while the bottom of link 137 is pivoted at 155 to the bottom of a slightly curved support link 157. An intermediate point of link 157 is pivoted at 158 to long link 153 and the top of the curved link 157 is pivoted at 159 to an angle shaped bracket 161 that is secured by fasteners 162 extending through holes 65 to the metal cross rail 47 of the chair frame assembly 5. An offset, ribbed spacer and stabilizer link 163 is also pivoted at 159 to the bracket 161 and jounaled at its lower end for relative angular movement on the cross shaft 16 which is operated by handle 15.

The bottom of each long support link 153 is pivoted at 164 to the bottom of the long leg 165 of a U-shaped drive and spacer bracket 167 which is mounted on and turns with the drive shaft 16. The bracket 167 has a short leg 164, parallel to leg 165, and joined to it by the base 171 of the U which extends parallel to the shaft 16. Long leg 165 has a square hole for the shaft 16 to provide means whereby turning of the shaft about its axis also turns the brackets 167 to swing legs 165 and 169. Counterclockwise rotation of the long legs 165 (handle 15 moves toward the rear of the chair) moves them toward the front of the chair to drive the long links 153 and actuates the pantograph, in conjunction with fixed pivots 159, so that the leg rest frame 125 goes from the vertical stowed position of FIGS. 1 and 2 to an extended horizontal position (not shown) described in the patents referred to above. A tab 173 pressed in each link 157 engages the long link 153 at shallow recess 175 to limit extension of the pantograph when the leg rest frame has turned ninety degrees and reaches horizontal position.

Left and right hand metal toggle link mechanisms 181 of the type shown in the aforementioned patents and patent application are mounted on drive shaft 16 which is located slightly below and to the rear of the pivots 33 (FIG. 3) and rotatably supported in opposite side frame members 37 of the chair frame assembly 5. Each provides means to hold the leg rest frame 125 in the fully retracted positions of FIGS. 1 and 2 against the front of the chair frame and it also supplies a spring assist to extension of the leg rest. The mechanism 181 comprises a short lever 183 (FIG. 5) with a square hole receiving shaft 119 whereby the lever turns with the shaft. The lever 183 is pivoted at 185 (FIG. 2) to the bottom front end of a C-shaped toggle link 187 that curves around the outside of spacer 167 to extend rearwardly substantially parallel at 188 to long leg 165 of the spacer 167. At its rear end it has an opening in which is hooked at 189 the front end of a helical coil tension spring 191. The rear end of the spring is hooked at 193 to a flange 195 of an angle-shaped bracket 197 that is solidly fixed to the top of the cross beam 27. The spring 191 makes an included obtuse angle with the rather, straight portion 188 of the toggle 187 and is under tension in the leg rest retract position of FIGS. 1 and 2. When the leg rest is extended, the drive shaft is rotated counterclockwise in FIG. 2 to raise the front end of the toggle 187 and move the rear end 188 slightly to the rear whereby it moves closer to flange 195. This reduces the included angle between the spring and section 188, reduces tension in the spring 191 and also allows it to assist the handle 15 in turning the shaft once the pivot point 185 has gone over center with respect to the shaft 16.

Figure 4:
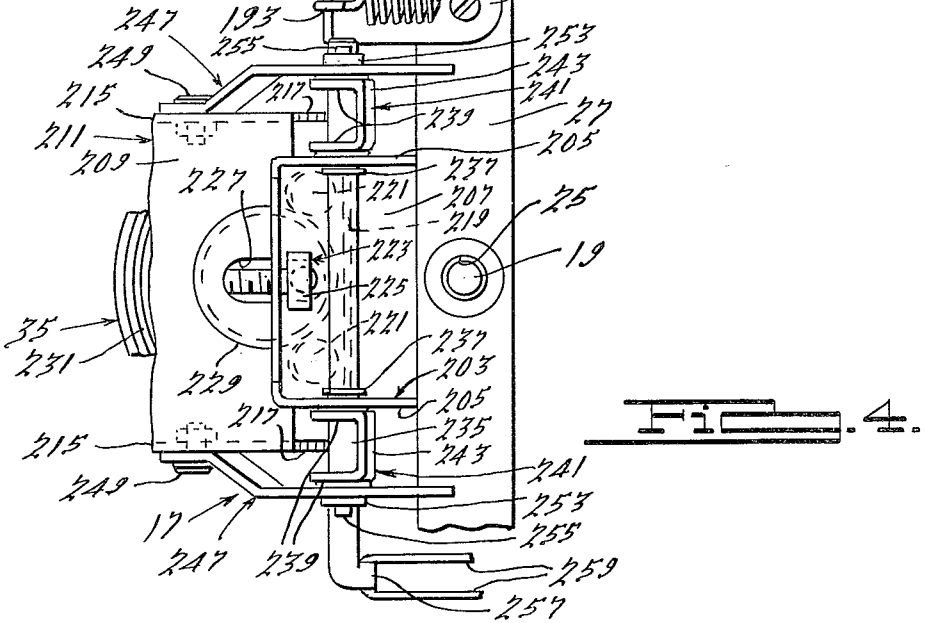
FIG. 4 is a top plan view, broken away, of the carriage assembly cross beam and the spring and ratchet mechanism for controlling rocking of the chair.
Figure 5:
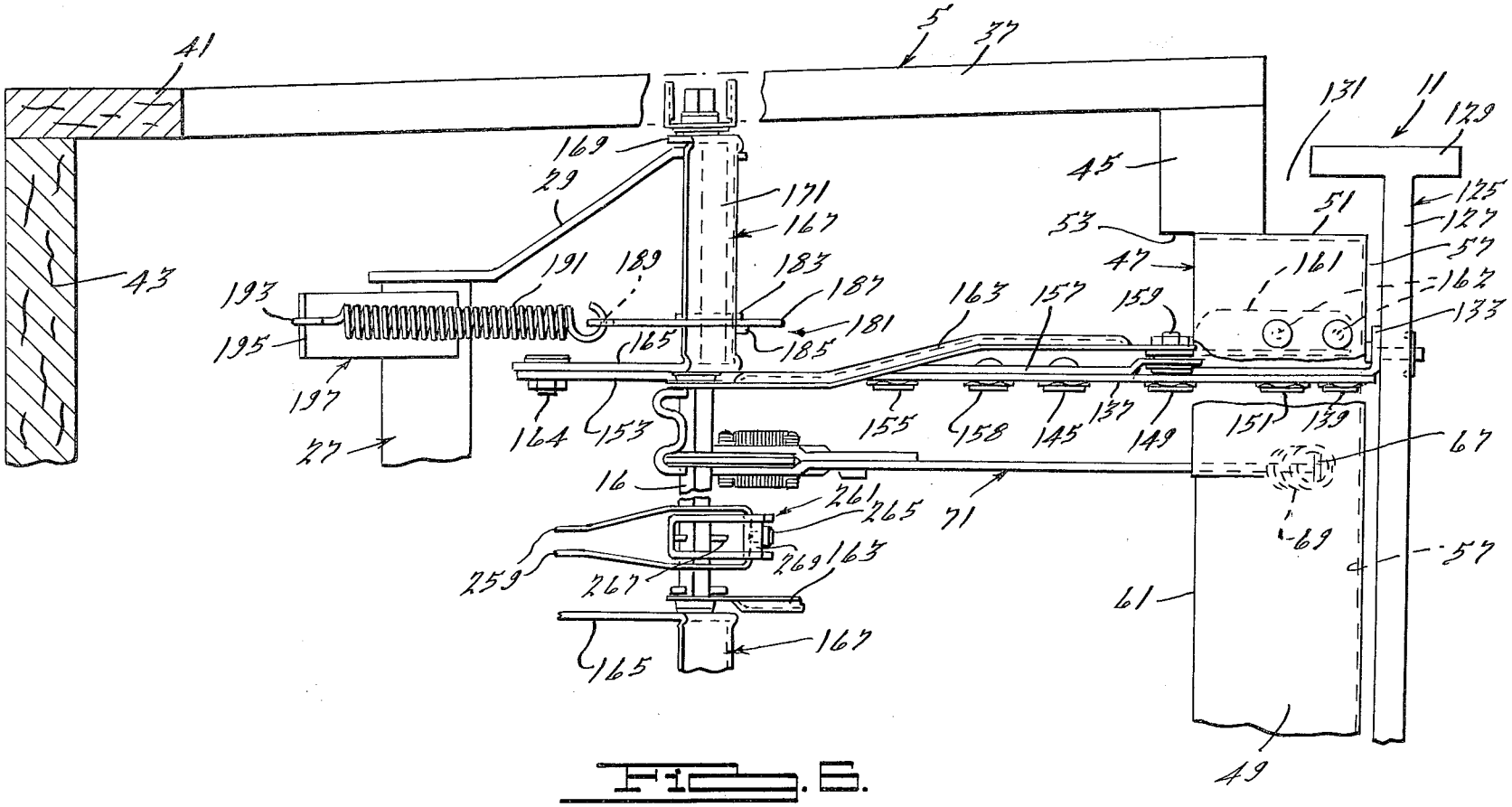

The carriage cross beam 27 has just been described as the base for the spring biased toggle mechanism 181. It is also the base for controlling rocking of the chair frame assembly 5 on pivots 33. The structure for accomplishing this includes the ratchet mechanism 17 which prevents rocking when the leg rest is extended. It also includes the adjustable spring means 35 that provides an adjustable, yieldable resistance to rocking of the chair. For this purpose a metal bracket 203 is solidly fixed to the rear of the beam 27, as by welding (FIGS. 3 and 4). The bracket 203 has two side legs 205 extending toward the rear of the chair and a transverse web 207 integral with the legs 205. The web 207 extends toward the rear of the chair and is upwardly inclined in this direction as seen in FIG. 3.

The web 207 is inclined at an angle of about 30° and it overlies a similarly inclined web 209 on a rigid metal bracket 211 that is solidly secured to the transverse rear frame member 43 of the chair frame assembly. This attachment is made by means of top and side flanges 213 extending outwardly from the web 209. The bracket 211 also has vertical side flanges 215 which extend forwardly and downwardly with the web 209 and have ratchet teeth 217 formed on their front edges. The web 209 actually projects forwardly beyond the toothed edges 217 of the side flanges and terminates in an upturned right angle flange 219 which serves to space the web 209 at least the height of the flange away from the bottom of web 207. Rubber bumper pads 221 (FIG. 4) are preferably secured to the top of web 209 to provide soft contact with the bottom of the web 207.

Such contact is continuously urged by the spring means 35. This includes a threaded stud 223 that has a head 225 that bears on the top of the web 207 (FIG. 4). The stem of threaded stud 223 passes through a round hole in the web 207 and through a fore and aft slot 227 in an upraised circular embossment 229 pressed into web 209. A coil spring 231 has its top end seated in the embossment 229. Its bottom end is engaged by a pressure plate and cup which is next to a handle 233 that is threaded on to the stud 223. The bearing of stud head 225 on the top of the web 207 fixes its position. Thus, when the handle 233 is turned to thread upwardly on the stud it compresses the spring 231 and increases the resistance to separation of flange 209 from flange 207. Such separation tends to occur when a chair occupant rocks the chair frame assembly backwards on pivots 33. However, the pressure of spring 231 as well as the weight of the chair parts (which is concentrated forwardly of the pivots 33) tend to urge the chair to a forward or upright position with the webs 207 and 209 in pressure contact via the bumpers 221. The degree of pressure can be adjusted by rotation of the handle 233. When the chair frame assembly 5 is rocked back on pivots 33, the web 209 will separate from web 207 and its angular position will change relative to the web 207 and the stud 223. This relative movement with respect to the stud is accommodated by the slot 227 in the web 209.

In order to provide the ratchet mechanism 17, a cross rod 235 is rotatably supported by bushings 237 in the two sides 205 of the beam bracket 203. However, the rod is of square cross section and extends through square openings in the opposite sides 239 of two U-shaped ratchet pawls 241 so that the pawls turn with the rod. The pawls 241 have center webs 243 which terminate in bottom edges 245. They are slightly inturned to enable them to efficiently cooperate with the ratchet teeth 217 with which the pawls are longitudinally aligned (FIG. 4). The inner sides 239 of the pawls are adjacent the legs 205 of the beam bracket 203. The outer sides 239 of the pawls are adjacent offset slotted forward end parts of guide and rock control links 247 that are pivoted at their rear ends to the sides 215 of chair frame bracket 211, as shown at 249. The rod 235 is pivotably supported in the slots 251 of the links 247 by bushings 253. The slots 251 determine how far back the chair frame assembly 5 can rock. When the links 247 move with the web 209, they act with the sides 205 to maintain the pawls 241 in alignment with the ratchet teeth 217. Transverse cotter keys 255 extending through the rod 235 on the outer ends of bushings 253 hold the various parts and the rod in the proper relative positions.

In order to move the pawls 241, the rod 235 is bent at its right end to provide a lever arm portion 257. A relatively stiff but still flexible wire loop 259 extends through an aperture in the bottom of lever portion 257. Rearward movement of the stiff wire 259 will push the arm 257 to the rear, rotating the rod 235 and the pawls 241 in a clockwise direction so that the bottom edges 245 are brought into operative over center contact with the ratchet teeth 217 and held there through the range of rearward rocking motion of the chair frame assembly 5. As the web 209 moves farther away from web 207, the pawls under load from the wire 259 remain in operative engagement with the teeth and prevent the web 209 from moving back toward the web 207, i.e., prevent the chair from rocking forward.

The stiff wire loop 259 is moved by the cross shaft 16, i.e., the handle 15, and with the leg rest assembly 11. For this purpose, a U-shaped lever 261 has square holes through its two legs whereby it is mounted on and rotates with the shaft 16 (FIG. 6). A tube 263 extends between and is fixed to the outer ends of the two legs of the lever and the wire loop passes through it, being held there by a lock screw 265 threaded radially into the tube. A cotter key 267 through shaft 16 between the two legs of lever 261 maintains it in proper location. When the lever is in the position of FIG. 6, i.e., leg rest retract, the wire loop 259 has pulled the pawls 243 out of contact with the ratchet teeth. However, if the handle 15 is pulled back to rotate shaft 16 counterclockwise and raise the leg rest assembly 11, the lever 263 will rotate so that tube 265 moves toward the rear of the chair to push the wire rearwardly and actuate the pawls. The wire loop 259 has sufficient flexibility to accomodate relative part movement while still pushing the pawls against the ratchet teeth. When the leg rest is lowered by rotation of the handle 15 back to the position of FIG. 1, the lever will rotate back to its position of FIG. 6 and pull the wire loop 259 to pull lever arm 257 and rotate rod 235 so that the pawls 241 are pulled out of contact with the ratchet teeth 217. Then the chair frame assembly can rock back and forth on pivots 33.

In the foregoing manner, the invention provides an office chair construction in which the metal arch rail 47 furnishes strength to the chair frame and support for the leg rest. The leg rest operating mechanism reacts in part against the cross rail 47 and includes the toggle mechanisms 181 which react via springs 191 against the span beam 27. The back frame and seat frame also react in part against the rail 47 by way of swing links 75 as does the detent mechanism 71 via spring 69. The handle operated square drive shaft 16 operates the leg rest and also turns lever 261 to actuate the ratchet mechanism 17 for controlling rocking of the chair.

Modifications in the specific details shown may be made without departing from the spirit and scope of the invention.

I claim:

1. An office chair comprising a mobile pedestal-type carriage including a vertical column and a horizontal span beam mounted on top of said column, a chair frame, said chair frame including a transverse front rail member, said front rail member being formed of metal and of an arch-shaped configuration with a top horizontal web section and with substantially vertical left and right hand downwardly extending side legs, pivot means between the chair frame and said span beam to provide for rocking movement of said frame about a fixed horizontal axis, a seat frame, links attached at their upper ends to the seat frame and at their lower ends to the respective left and right hand side legs of said front rail member to movably support the front of said seat frame on said rail member, a leg rest frame, pantograph linkage mechanism secured to and carrying the load of said leg rest and operable to move said leg rest frame between an extended substantially horizontal position and a retracted substantially vertical position adjacent to said front rail member, said pantograph linkage mechanism being supported on said front rail member, operating means for said pantograph linkage mechanism including a horizontal rotary drive shaft journaled at opposite ends on said chair frame and further including a spring biased toggle mechanism driven by said drive shaft and resiliently connected at a rear end portion to said span beam.

2. An office chair as set forth in claim 1 wherein said metal rail has a flange formed along its front end on said web section and legs and a depression adjacent the rear of the web section.

3. An office chair as set forth in claim 1 wherein the chair frame is formed of wood and the side legs of the metal rail have outwardly extending apertured extrusions for penetrating engagement with the wood of the chair frame, and fasteners extending through the extrusions to secure the rail to the frame.

4. An office chair as set forth in claim 3 wherein said metal rail has apertured inwardly extending embossments on said side legs and means pivoting the lower ends of said links to said legs in engagement with said embossments.

5. An office chair comprising a mobile base, a chair frame including left and right wooden side members each including an upwardly extending post section at the rear thereof, said chair frame including a transverse rear frame member extending between the rear of the side members and rigidly uniting them and a transverse front rail member extending between the front of the side members and rigidly uniting them, said front rail member being formed of metal and of an arch-shaped configuration with a top horizontal web section and with substantially vertical left and right hand downwardly extending side legs secured respectively to said left and right hand side members, pivot means between the base and the side members for mounting the chair frame on said base for rocking movement about a fixed horizontal axis, a seat frame, left and right hand swing links pivoted at their upper ends to the seat frame and at their lower ends to the respective left and right hand side legs of said front rail member to support the front of said seat frame on said rail member, a leg rest frame, left and right hand pantograph linkage mechanisms secured to and carrying the load of said leg rest and operable to move said leg rest frame between an extended substantially horizontal position, and a retracted substantially vertical position adjacent to said front rail member, said pantograph linkage mechanisms being supported on said front rail member, operating means for said pantograph linkage mechanisms including a horizontal rotary drive shaft journaled at opposite ends in said left and right hand side members of said chair frame and further including spring biased left and right hand toggle mechanisms driven by said drive shaft and resiliently connected at their rear end portions to said base, a back frame, and left and right hand swing linkages movably mounting said back frame and the rear of said seat frame on said side frame member post sections for joint movement between a front position wherein the back frame is upright and the seat frame is down and retracted and a rear position wherein the back frame is reclined and the seat frame is up and extended, and a detent mechanism for supporting the leg rest including a coil spring anchored on the top, horizontal web portion of said front rail.

6. A chair comprising a base, a chair frame including left and right wooden side members each including an upwardly extending post section at the rear thereof, said chair frame including a transverse rear frame member extending between the rear of the side members and rigidly uniting them and a transverse front rail member extending between the front of the side members and rigidly uniting them, said front rail member being formed of metal and of an arch-shaped configuration with a top horizontal web section and with substantially vertical left and right hand downwardly extending side legs secured respectively to said left and right hand side members, means mounting the chair frame on said base, a seat frame, left and right hand swing links pivoted at their upper ends to the seat frame and at their lower ends to the respective left and right hand side legs of said front rail member to support the front of said seat frame on said rail member, a leg rest frame, left and right hand pantograph linkage mechanisms secured to and carrying the load of said leg rest and operable to move said leg rest frame between an extended substantially horizontal position, and a retracted substantially vertical position adjacent to said front rail member, said pantograph linkage mechanisms being supported on said front rail member, operating means for said pantograph linkage mechanisms including a horizontal rotary drive shaft journaled at opposite ends in said left and right hand side members of said chair frame and further including spring biased left and right hand toggle mechanisms driven by said drive shaft and resiliently connected at their rear end portions to said base, a back frame, and left and right hand swing linkages movably mounting said back frame and the rear of said seat frame on said side frame member post sections for joint movement between a front position wherein the back frame is upright and the seat frame is down and retracted and a rear position wherein the back frame is reclined and the seat frame is up and extended.

7. An office chair comprising a mobile base, a chair frame, pivot means for mounting the chair frame on said base for rocking movement about a fixed horizontal axis, a seat frame, left and right hand swing links pivoted at their upper ends to the seat frame and at their lower ends to the chair frame to support the front of said seat frame chair, a leg rest frame, left and right hand pantograph linkage mechanisms secured to and carrying the load of said leg rest and operable to move said leg rest frame between an extended substantially horizontal position and a retracted substantially vertical position adjacent to the front of said chair frame, said pantograph linkage mechanisms being supported on said chair frame, operating means for said pantograph linkage mechanisms including a horizontal rotary drive shaft journaled at opposite ends in said chair frame and further including spring biased left and right hand C-shaped toggle mechanisms driven by and around said drive shaft and resiliently connected at their rear end portions to said base, said drive shaft being located closely adjacent to said fixed horizontal axis, a back frame, and left and right hand swing linkages movably mounting said back frame and the rear of said seat frame on said side frame member post sections for joint movement between a front position wherein the back frame is upright and the seat frame is down and retracted and a rear position wherein the back frame is reclined and the seat frame is up and extended, a bracket with ratchet teeth secured to said chair frame, a bracket with movable ratchet pawls secured to said base so that the pawls are aligned with the ratchet teeth, flexible wire means connected to the ratchet pawls for urging them into contact with the ratchet teeth, a lever mounted on said drive shaft for rotary movement with it, said lever being operatively connected to said flexible wire means so that it urges the pawls against the ratchet teeth when the drive shaft is turned to extend the leg rest whereby rocking of the chair frame on said pivot means is precluded when the leg rest is extended.

8. An office chair comprising a mobile base including a vertical column and a horizontal span beam mounted on top of said column, said span beam including forwardly extending rigid arms at opposite ends thereof, a rigid chair frame including left and right wooden side members, said chair frame including a transverse rear frame member extending between the rear of the side members and rigidly uniting them and a transverse front rail member extending between the front of the side members and rigidly uniting them, said front rail member being formed of metal and of an arch-shaped configuration with a top horizontal web section and with substantially vertical left and right hand downwardly extending side legs secured respectively to said left and right hand side members, pivot means between the front ends of said arms and the side members for mounting the chair frame on said span beam for rocking movement about a fixed horizontal axis, a seat frame, left and right hand links pivoted at their upper ends to the seat frame and at their lower ends to the respective left and right hand side legs of said front rail member to support the front of said seat frame on said rail member, a leg rest frame, left and right hand linkage mechanisms secured to and carrying the load of said leg rest and operable to move said leg rest frame between an extended substantially horizontal position and a retracted substantially vertical position adjacent to said front rail member, said linkage mechanisms being supported on said front rail member, operating means for said linkage mechanisms including a horizontal rotary drive shaft adjacent said horizontal axis and journaled at opposite ends in said left and right hand side members of said chair frame and further including spring biased left and right hand toggle mechanisms driven by said drive shaft and movable over the center thereof and resiliently connected at their rear end portions to said span beam, a back frame, and left and right hand linkages movably mounting said back frame and the rear of said seat frame on said side frame members for joint movement between a front position wherein the back frame is upright and the seat frame is down and retracted and a rear position wherein the back frame is reclined and the seat frame is up and extended, adjustable means for controlling resistance of the back frame to movement, adjustable means for controlling resistance of the chair frame to rocking about said axis, and means responsive to the position of the leg rest for resisting rocking when the leg rest is in an extended position

9. An office chair as set forth in claim 8 including wooden blocks extending inwardly from the front ends of the chair from side members, said front rail side legs being secured to said blocks so that a substantial part of the front lies forwardly of the blocks and the side members to define open corners with the front ends of the side members, said leg rest frame being H-shaped with the side legs of the H resting in said open corners and the web of the H being parallel and adjacent to the front edge of the metal rail when the leg rest is in its restricted position.

10. An office chair comprising a mobile pedestal-type carriage including a vertical column and a rigid horizontal metal span beam mounted on top of said column, said span beam including forwardly extending rigid arms at opposite ends thereof, a chair frame including left and right wooden side members each including an upwardly extending post section at the rear thereof, said chair frame including a transverse rear frame member extending between the rear of the side members and rigidly uniting them and a transverse front rail member extending between the front of the side members and rigidly uniting them, said front rail member being formed of metal and of an arch-shaped configuration with a top horizontal web section and with substantially vertical left and right hand downwardly extending side legs secured respectively to said left and right hand side members, pivot means between the front ends of said arms and the side members for mounting the chair frame on said span beam for rocking movement about a fixed horizontal axis, a seat frame, left and right hand swing links pivoted at their upper ends to the seat frame and at their lower ends to the respective left and right hand side legs of said front rail member to support the front of said seat frame on said rail member, a leg rest frame, left and right hand pantograph linkage mechanisms secured to and carrying the load of said leg rest and operable to move said leg rest frame between an extended substantially horizontal position and a retracted substantially vertical position adjacent to said front rail member, said pantograph linkage mechanisms being supported on said front rail member, operating means for said pantograph linkage mechanisms including a horizontal rotary drive shaft journaled at opposite ends in said left and right hand side members of said chair frame and further including spring biased left and right hand toggle mechanisms driven by said drive shaft and resiliently connected at their rear end portions to said span beam, a back frame, left and right hand swing linkages movable mounting said back frame and the rear of said seat frame on said side frame member post sections for joint movement between a front position wherein the back frame is upright and the seat frame is down and retracted and a rear position wherein the back frame is reclined and the seat frame is up and extended, a bracket with ratchet teeth secured to said transverse rear frame member, a bracket with movable ratchet pawls secured to said span beam so that the pawls are aligned with the ratchet teeth, flexible stiff wire means connected to the ratchet pawls for urging them into contact with the ratchet teeth, a lever mounted on said drive shaft for rotary movement with it, said lever being operatively connected to said flexible stiff wire means so that it urges the pawls against the ratchet teeth when the drive shaft is turned to extend the leg rest whereby rocking of the chair frame on said pivot means is precluded when the leg rest is extended.

* * * * *